United States Patent [19]

Ishimi et al.

[11] Patent Number: 4,565,163

[45] Date of Patent: Jan. 21, 1986

[54] V-TYPE ENGINE

[75] Inventors: Haruyoshi Ishimi; Koji Asanomi, both of Hiroshima, Japan

[73] Assignee: Mazda Motor Corporation, Hiroshima, Japan

[21] Appl. No.: 601,959

[22] Filed: Apr. 19, 1984

[30] Foreign Application Priority Data

Apr. 21, 1983 [JP] Japan ..... 58-70657
Mar. 26, 1984 [JP] Japan ..... 59-57717

[51] Int. Cl.[4] ..... F02B 67/00; F01P 5/12; F02B 75/22

[52] U.S. Cl. ..... 123/41.44; 123/41.74; 123/55 VS

[58] Field of Search ..... 123/41.01, 41.1, 41.17, 123/41.44, 41.47, 41.46, 41.72, 41.74, 55 VF, 55 VS, 55 VE, 55 V

[56] References Cited

U.S. PATENT DOCUMENTS

| | | | |
|---|---|---|---|
| 1,764,744 | 6/1930 | Niven | 123/41.44 |
| 2,479,585 | 8/1949 | Monroe | 123/41.46 |
| 2,713,332 | 7/1955 | Beardsley | 123/41.74 |
| 2,852,009 | 9/1958 | Turlay | 123/41.47 |
| 2,963,007 | 12/1960 | Leach | 123/55 VE |
| 2,963,009 | 12/1960 | Dolza | 123/55 VS |
| 3,003,484 | 10/1961 | Rohrbacher et al. | 123/41.47 |
| 3,361,000 | 1/1968 | Buchwald | 123/195 A |
| 4,448,159 | 5/1984 | Hidaka et al. | 123/41.44 |

FOREIGN PATENT DOCUMENTS

| | | | |
|---|---|---|---|
| 0114845 | 9/1980 | Japan | 123/55 VE |

*Primary Examiner*—Craig R. Feinberg
*Assistant Examiner*—David A. Okonsky
*Attorney, Agent, or Firm*—Murray, Whisenhunt and Ferguson

[57] ABSTRACT

A V-type engine comprises a cylinder block forming first and second cylinder banks arranged in V-shape. Each cylinder bank is provided with a row of cylinders extending in the axial direction of the crankshaft between the front and rear ends of the engine. The cylinder row in the second cylinder bank starts from a location spaced apart from the front end of the engine and the cylinder row in the first cylinder bank starts from a location near the front end of the engine so that the cylinder row in the second cylinder bank is axially rearwardly displaced from that in the first cylinder bank. A water pump is mounted on the front end of the cylinder block substantially at the center between the first and second cylinder banks. A coolant inlet-passage to the water pump is provided in the part of the cylinder block between the foremost cylinder in the second bank and the front end of the cylinder block, which part is a dead space.

15 Claims, 12 Drawing Figures

V-TYPE ENGINE

BACKGROUND OF THE INVENTION

1. Field of the Invention

This invention relates to a V-type engine, and more particularly to an improvement in the engine cooling system of a V-type engine.

2. Description of the Prior Art

In Japanese Unexamined Patent Publication No. 55(1980)-114845, there is disclosed an arrangement of the engine cooling system for a V-type engine in which the row of cylinders in one bank is rearwardly displaced from the row of cylinders in the other bank in the axial direction of the crankshaft so that a space is formed forwardly of the one bank, and a water pump is disposed in this space, thereby reducing the overall size of the engine.

However, this arrangement is disadvantageous in that the cylinder block becomes irregular in shape, which adversely affects manufacture of the cylinder block, and coolant cannot be uniformly distributed to the banks since the water pump is disposed off-center toward one bank. That is, from the viewpoint of manufacture of the cylinder block, it is preferably regular in shape, and from the viewpoint of distribution of coolant to the banks, the water pump is preferred to be disposed at the center between the banks.

SUMMARY OF THE INVENTION

The primary object of the present invention is to provide a V-type engine in which the engine cooling system is compactly incorporated in the engine without adversely affecting the distribution of coolant to the cylinder banks.

The V-type engine of the present invention comprises a cylinder block forming first and second cylinder banks arranged in V-shape. Each cylinder bank is provided with a row of cylinders extending in the axial direction of the crankshaft between the front and rear ends of the engine. The cylinder row in the second cylinder bank starts from a location spaced apart from the front end of the engine and the cylinder row in the first cylinder bank starts from a location near the front end of the engine so that the cylinder row in the second cylinder bank is axially rearwardly displaced from that in the first cylinder bank. A water pump is mounted on the front end of the cylinder block substantially at the center between the first and second cylinder banks. A coolant inlet-passage to the water pump is provided in the part of the cylinder block between the foremost cylinder in the second bank (the cylinder nearest to the front end of the engine in the second cylinder bank) and the front end of the engine, which part is a dead space.

In the V-type engine in accordance with the present invention, uniform distribution of coolant to the first and second cylinder banks is ensured since the water pump is disposed at the center between the cylinder banks, and at the same time, the overall size of the engine can be reduced, since the coolant inlet-passage to the water pump is disposed in the dead space inherently formed between the front end of the engine and one of the cylinder banks.

In one embodiment of the present invention, the inlet of the coolant inlet-passage, to which the conduit means from the radiator is connected, opens in the front end faces of the cylinder block. Generally, this arrangement is preferred since V-type engines are apt to be large in the direction transverse to the cylinder rows and it is not preferred to mount parts that project sideways. However, the inlet of the coolant inlet-passage may be arranged to open in the outer side wall of the cylinder block on the second cylinder bank side.

DESCRIPTION OF THE PREFERRED EMBODIMENT

Figure 1:
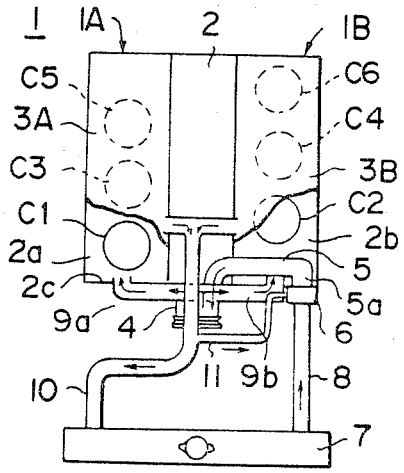
FIG. 1 is a schematic plan view illustrating a V-type engine in accordance with an embodiment of the present invention.
Figure 2:
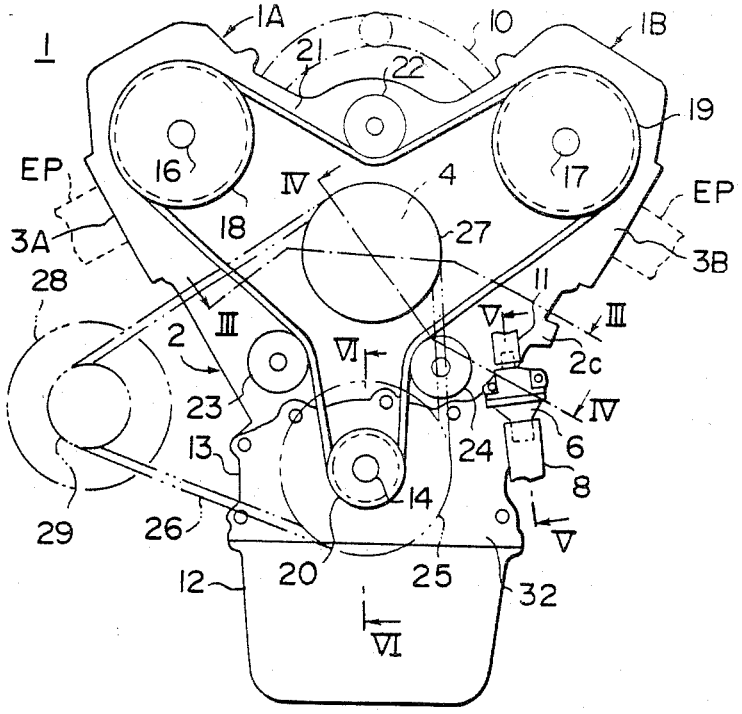
FIG. 2 is a schematic front elevational view of the V-type engine.

FIG. 1 is a schematic plan view illustrating an engine cooling system of a V-6 engine in accordance with an embodiment of the present invention, and FIG. 2 is a schematic front elevational view of the V-6 engine. Referring to FIGS. 1 and 2, the V-6 engine 1 of this embodiment includes a cylinder block 2 having first and second cylinder banks 1A and 1B arranged in V-shape. To the bottom of the cylinder block 2 is attached an oil pan 12 which defines, together with the lower part of the cylinder block 2, a crankcase 13. A crankshaft 14 is supported for rotation in the crankcase 13. Mounted on the top surfaces of the first and second cylinders banks 1A and 1B of the cylinder block 2 in air-tight fashion are first and second cylinder heads 3A and 3B. First and second camshafts 16 and 17 are respectively supported on the first and second cylinder heads 3A and 3B. The first and second camshafts 16 and 17 are operatively connected at their front ends with the crankshaft 14 through a transmission means so that they are rotated in synchronization with the crankshaft 14. The transmission means comprises timing pulleys 18 and 19 respectively fixedly mounted on the front ends of the camshafts 16 and 17, a first crank pulley 20 fixed on the front end of the crankshaft 14, and a timing belt 21 entrained around the pulleys 18, 19 and 20. Reference numerals 22, 23 and 24 denote idlers for the timing belt 21.

As clearly shown in FIG. 1, in the first cylinder bank side portion **2*a* of the cylinder block 2, there is formed a row of three cylinders assigned odd numbers C1, C3 and C5, whereas in the second cylinder bank side portion 2*b***, there is formed a row of three cylinders assigned even numbers C2, C4 and C6. The row of the cylinders C1, C3 and C5 in the first cylinder bank 1A starts from a location near the front end face 2c of the cylinder block 2 and terminates at a location spaced apart from the rear end face of the same. The row of the cylinders C2, C4 and C6 starts from location spaced apart from the front end face 2c of the cylinder block 2 and terminates at a location near the rear end face of the same. That is, the foremost cylinder C1 in the first cylinder bank 1A is disposed near the front end face 2c of the cylinder block 2, while the foremost cylinder C2 in the second cylinder bank 1B is disposed spaced apart from the front end face 2c of the cylinder block 2, whereby the row of the cylinders in the second cylinder block 1B is rearwardly displaced from that in the first cylinder bank 1A.

A water pump 4 is mounted on the front end face 2c of the cylinder block 2 at the center between the first and second cylinder banks 1A and 1B. A coolant inlet-passage 5 through which coolant is introduced into the water pump 4 is formed in the part of the cylinder block 2 between the front end face 2c and the foremost cylinder C2 in the second cylinder bank side portion 2b. The coolant inlet-passage 5 has an inlet 5a which opens in the front end face 2c of the cylinder block 2, and to which is connected a discharge conduit 8 of a radiator 7 by way of a thermostat 6.

The coolant discharged from the water pump 4 flows through first and second coolant feed passages 9a and 9b extending in opposite directions from the water pump 4 into the respective cylinder bank side portions 2a and 2b, and then goes up into the cylinder heads 3A and 3B of the respective cylinder banks 1A and 1B. The coolant discharged from the cylinder head 3A and the coolant discharged from the cylinder head 3B join each other and flow into an inlet conduit 10 of the radiator 7. A by-pass passage 11 extends between an intermediate portion of the inlet conduit 10 and the thermostat 6. The thermostat 6 communicates the by-pass passage 11 with the coolant inlet-passage 5 to shut off circulation of coolant to the radiator 7 when the engine is cold, and communicates the coolant inlet-passage 5 with the discharge conduit 8 of the radiator 7 when the engine gets hot.

As shown by the chained line in FIG. 2, a driving belt 26 is entrained around a second crank pulley 25 which is fixed to the front end of the crankshaft 14 and is larger than the first crank pulley 20 in diameter, a pump pulley 27 of the water pump 4, and a pulley 29 of an alternator 28 so that the water pump 4 and the alternator 28 are driven by the crankshaft 14.

Figure 5:
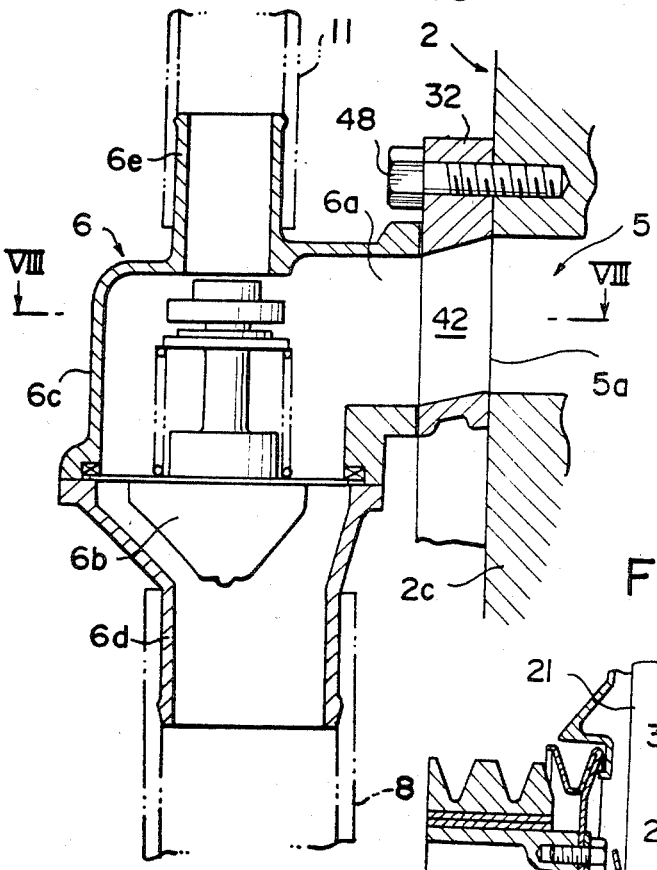
FIG. 5 is a fragmentary cross-sectional view taken along line V—V in FIG. 2.
Figure 6:
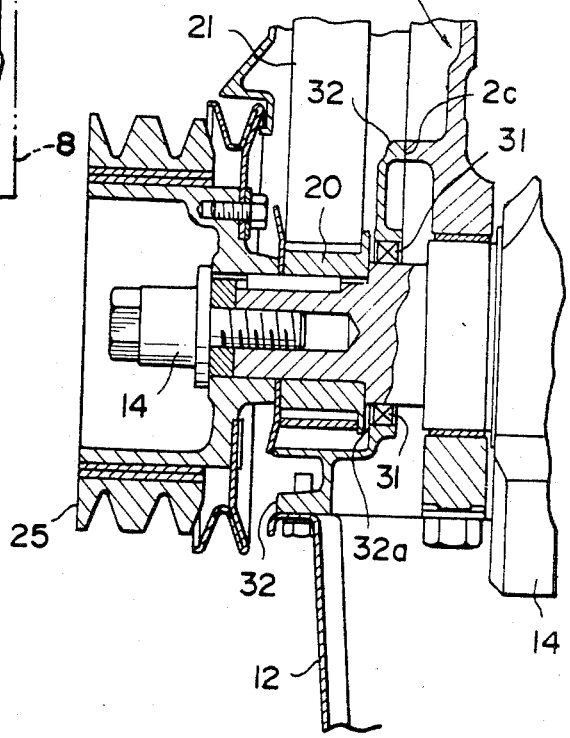
FIG. 6 is a fragmentary cross-sectional view taken along line VI—VI in FIG. 2.

To the front end face 2c of the cylinder block 2 is fixed a front cover 32 for retaining a front oil seal 31 for the crankshaft 14 as shown in FIG. 6. On the front face of the front cover 32 is mounted said thermostat 6 to which are connected said discharge conduit 8 of the radiator 7 and the by-pass passage 11. The front cover 32 is provided with a communicating opening 42 for communicating an outlet 6a of the thermostat 6 with the inlet 5a of the coolant inlet-passage 5, as clearly shown in FIGS. 4 and 5.

Figure 3:
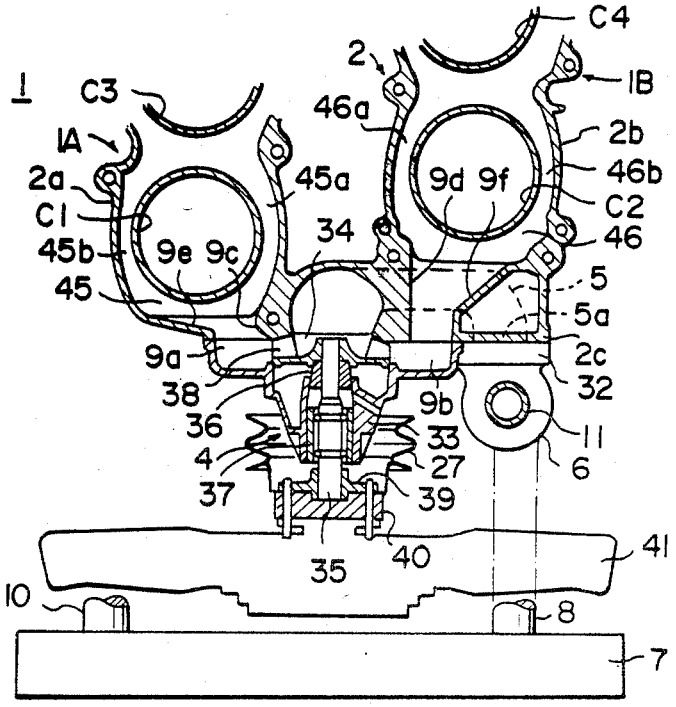
FIG. 3 is a fragmentary cross-sectional view taken along line III—III in FIG. 2.
Figure 4:
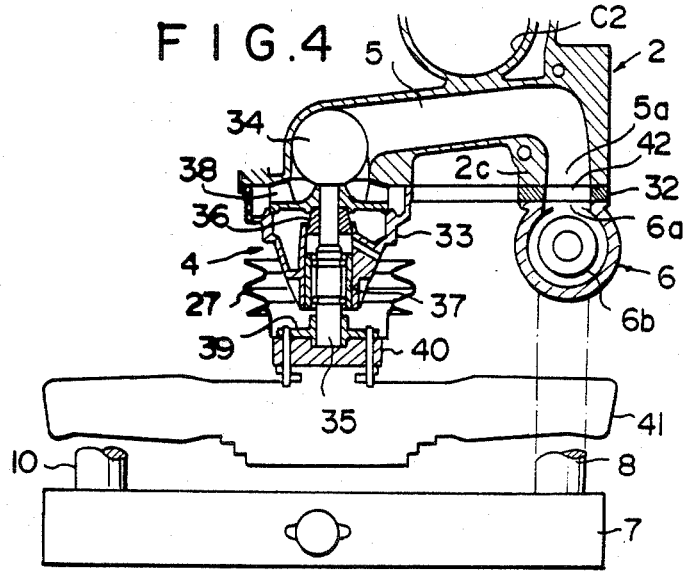
FIG. 4 is a fragmentary cross-sectional view taken along line IV—IV in FIG. 2.

As shown in FIGS. 3 and 4, the water pump 4 comprises a pump housing 33 which is directly mounted on the front end face 2c of the cylinder block 2 substantially at the center between the first and second cylinder banks 1A and 1B to form a pump chamber 34, and an impeller 38 mounted for rotation in the pump chamber 34. The impeller 38 is fixed to one end of a rotary shaft 35 which is rotatably supported by a bearing 37 carried by the pump housing 33. Reference numeral 36 denotes a water seal between the rotary shaft 35 and the pump housing 33. On the other end portion of the rotary shaft 35 are mounted a pump pulley 27 and an engine fan by way of mounting members 39 and 40, respectively. This arrangement of the water pump 4 is advantageous in that the rotary shaft 35 is not in the pump chamber 34 and the resistance to the coolant flow is reduced.

Said coolant feed passages 9a and 9b extend respectively between the front end face 2c of the cylinder block 2 and the cylinder C1 nearest to the front end face 2c in the first cylinder bank 1A, and between the front end face 2c and the cylinder C2 nearest to the front end face 2c in the second cylinder bank 1B, and have asymmetrically tapered cross sections as clearly shown in FIG. 3. This is because the coolant feed passages 9a and 9b are connected to the respective cylinder bank side portions 2a and 2b at locations inwardly shifted from the center of the cylinders C1 and C2 in the respective cylinder banks 1A and 1B. That is, the inner walls 9c and 9d of the respective coolant feed passages 9a and 9b extend substantially in the axial direction of the crankshaft 14, while the outer walls 9e and 9f of the respective coolant feed passages 9a and 9b are inclined outwardly with respect to the axial direction of the crankshaft 14 to extend respectively along the circumferences of the cylinders C1 and C2, so that the amounts of coolant flowing into the outer portions 45b and 46b of water jackets 45 and 46 formed around the respective cylinders C1 and C2 become at least equal to those of the coolant flowing into the inner portions 45a and 45b of the water jackets 45 and 46. Since exhaust pipes EP generally project from the outer side walls of the cylinder block 2 as shown by the dotted lines in FIG. 2, it is preferred that larger amount of coolant be fed to the outer portions 45b and 46b.

As can be seen from FIG. 3, the part of the second feed passage 9b extending in the axial direction of the crankshaft 14 is longer than the part of the first coolant feed passage 9a extending in the axial direction of the crankshaft 14 and the outer wall 9f of the second coolant feed passage 9b is inclined outwardly with respect to the axial direction of the crankshaft 14 less than the outer wall 9e of the first coolant feed passage 9a. This is for substantially equalizing the volume of the water jacket 45 in front of the cylinder C1 to that of the water jacket 46 in front of the cylinder C2 irrespective of the fact that the cylinder C2 in the second cylinder bank 1B is rearwardly displaced from the cylinder C1 in the first cylinder bank 1A, thereby uniformly distributing the coolant to the first and second cylinder banks 1A and 1B.

Figure 8:
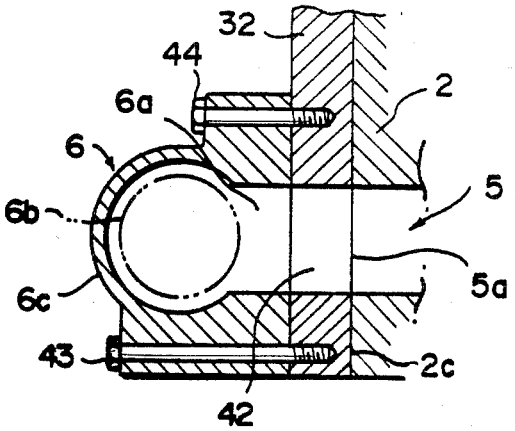
FIG. 8 is a fragmentary cross-sectional view taken along line VIII—VIII in FIG. 5.
Figure 9:
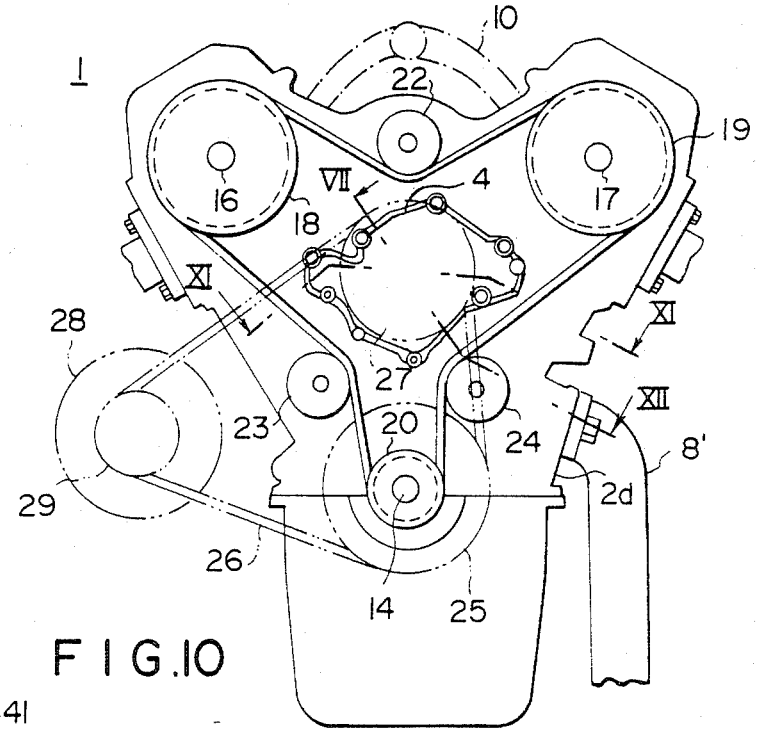
FIG. 9 is a schematic front elevational view of a V-type engine in accordance with another embodiment of the present invention.
Figure 10:
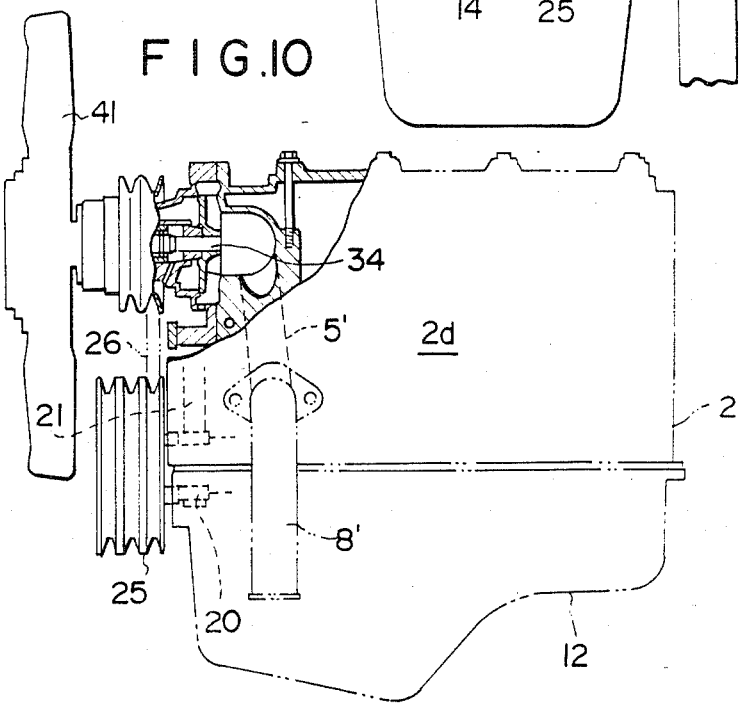
FIG. 10 is a fragmentary side elevational view partly cut away of the V-type engine shown in FIG. 9.
Figure 11:
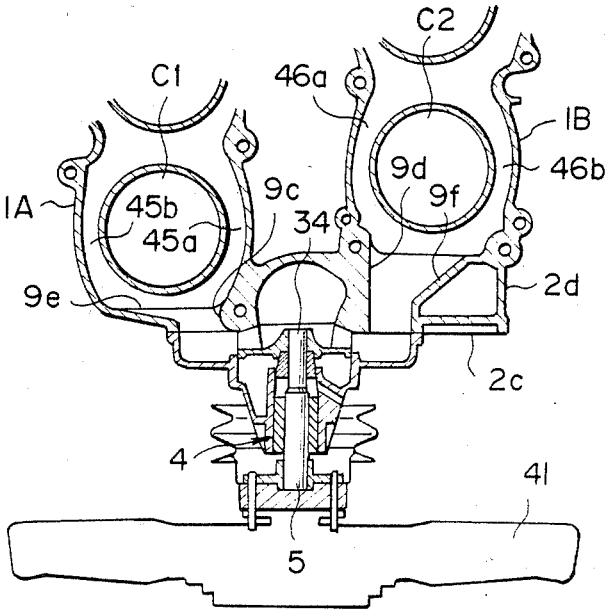
FIG. 11 is a fragmentary cross-sectional view taken along line XI—XI in FIG. 9.
Figure 12:
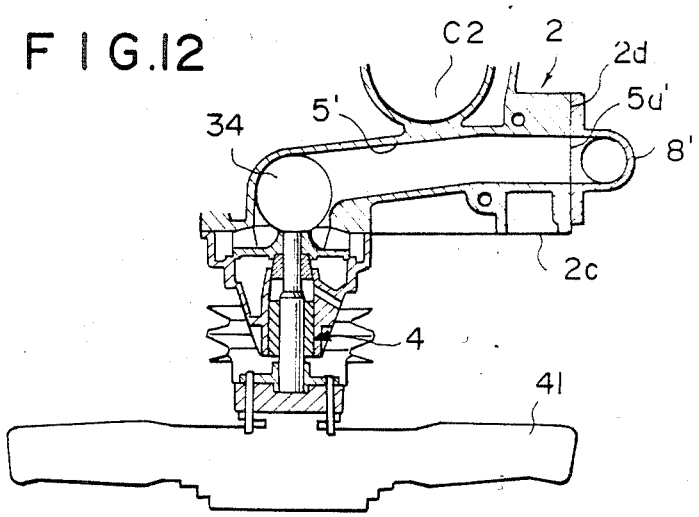
FIG. 12 is a fragmentary cross-sectional view taken along line XII—XII in FIG. 9.

As shown in detail in FIG. 5, said thermostat 6 comprises a body portion 6b and a casing 6c accommodating therein the body portion 6b. The casing 6c is fixed to the front cover 32 by means of bolts 43 and 44 as shown in FIG. 8. The casing 6c is provided with lower and upper tubular extensions 6d and 6e to which are respectively connected said discharge conduit 8 of the radiator 7 and the by-pass passage 11.

Figure 7:
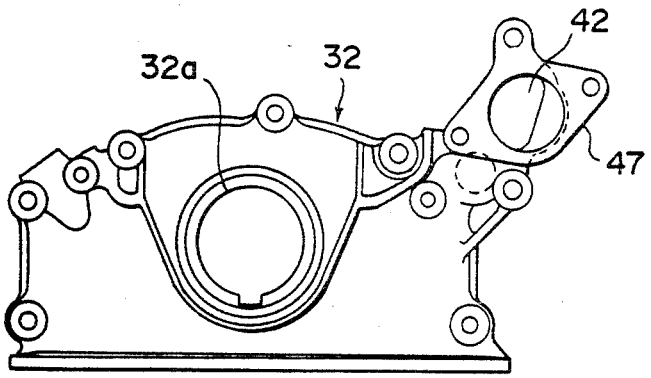
FIG. 7 is a front elevational view of the front cover employed in the engine.

Said front cover 32 is mounted on the front end face 2c of the cylinder block 2 and fixed to the oil pan 12 at its lower end as shown in FIGS. 6 and 7. The front cover 32 is further provided with a central opening 32a for receiving the front end portion of the crankshaft 14. Said front oil seal 31 for sealing outer surface of the crankshaft 14 is held in the central opening 32a. Said communicating opening 42 is formed in an upper corner of the front cover 32, and a flange portion 47 for mounting the thermostat 6 is formed around the communicating opening 42. The front cover 32 is fixed to the front end face *2c* of the cylinder block 2 by means of a plurality of bolts 48 one of which is shown in FIG. 5.

As can be understood from the description above, in the V-type engine in accordance with the present invention, the coolant can be uniformly distributed to the water jackets in the respective cylinder banks since the water pump is disposed at the center between the cylinder banks, and at the same time, the overall size of the engine can be made relatively small irrespective of the fact that the water pump is mounted on the front end face of the cylinder block since the coolant inlet-passage to the water pump is effectively incorporated in the dead space inherent to the V-type engine.

Though in the above embodiment, the pump chamber 34 of the water pump 4 is formed by the front end face *2c* of the cylinder block 2 and the pump housing 33, the pump chamber may be formed by the pump housing 33 and a separate plate member. In this case, the water pump is mounted on the front end face *2c* of the cylinder block 2 with the plate member in contact with the front end face *2c* of the cylinder block 2.

Further, though the coolant inlet-passage 5 to the water pump 4 opens in the front end face *2c* of the cylinder block 2 in the above embodiment, it may instead open in the side face of the cylinder block 2.

FIGS. 9 to 12 show another embodiment of the present invention in which the coolant inlet-passage to the water pump opens in the side face of the cylinder block.

The V-type engine shown in FIGS. 9 to 12 is substantially the same as the embodiment shown in FIGS. 1 to 8 except that the coolant inlet-passage 5' to the water pump 4 opens in the side face *2d* of the cylinder block 2 as indicated at *5a'*. To the open end *5a'* of the coolant inlet-passage 5' is connected a discharge conduit 8' of the radiator (not shown). Since the remaining structure of the V-type engine of this embodiment will be apparent to those skilled in the art in the light of the description of the embodiment shown in FIGS. 1 to 8, it will not be described here.

We claim:

1. A V-type engine having a crankshaft with an axis comprising a cylinder block having first and second cylinder banks, each cylinder bank having an outer side face and being provided with a row of a plurality of cylinders extending between front and rear end faces of the cylinder block in the axial direction of the crankshaft, the row of the cylinders in the first cylinder bank starting from a location near the front end face of the cylinder block and the row of the cylinders in the second cylinder bank starting from a location spaced apart from the front end face of the cylinder block, wherein the improvement comprises that a water pump of an engine cooling system is mounted on the front end face of the cylinder block substantially at the center between the first and second cylinder banks, and a coolant inlet-passage to the water pump is formed in the cylinder block between the front end face of the cylinder block at the second cylinder bank and the foremost cylinder in the second cylinder bank, the water pump having a pump chamber in which an impeller is rotated, said coolant inlet-passage being communicated with the pump chamber at one end and with a discharge conduit of a radiator at the other end, and said pump chamber being communicated with water jackets formed in the first and second cylinder banks, respectively, by way of first and second coolant feed passages.

2. A V-type engine as defined in claim 1 in which said other end of the coolant inlet-passage to the water pump opens in the front end face of the cylinder block to form an inlet thereinto to which the discharge conduit of the radiator is connected.

3. A V-type engine as defined in claim 1 in which said other end of the coolant inlet-passage to the water pump opens in the outer side face of the cylinder block at the second cylinder bank to form an inlet thereinto to which the discharge conduit of the radiator is connected.

4. A V-type engine as defined in claim 1 in which said coolant inlet-passage is defined by a wall portion in the cylinder block which is partly common with a wall portion defining the cylinder nearest to the front end face of the cylinder block in the second cylinder bank.

5. A V-type engine as defined in claim 1 further comprising first and second camshafts respectively mounted for rotation on the first and second cylinder banks, the first and second camshafts being operatively connected with the crankshaft to be rotated in synchronization therewith, by way of cam pulleys fixedly mounted on one ends of the respective camshafts, a crank pulley fixedly mounted on the corresponding end of the crankshaft and a transmission member entrained around the cam pulleys and the crank pulleys, said water pump being disposed inside the transmission member.

6. A V-type engine as defined in claim 1 in which said pump chamber is formed by the front end face of the cylinder block and a pump housing directly fixed to the front end face of the cylinder block, said one end of the coolant inlet-passage to the water pump opening in the front end face of the cylinder block.

7. A V-type engine as defined in claim 6 in which said impeller is fixedly mounted on the rear end of a rotary shaft which is mounted on the pump housing for rotation at the front end portion thereof, the rotary shaft being arranged to be driven by the crankshaft of the engine.

8. A V-type engine as defined in claim 1 in which each of said coolant feed passages has an inner wall portion extending substantially in the axial direction of the crankshaft and an outer wall portion inclined outwardly with respect to the axial direction of the crankshaft so that the coolant feed passage is flared toward the corresponding water jacket.

9. A V-type engine as defined in claim 8 in which said outer wall portion of the second coolant feed passage is inclined with respect to the axial direction of the crankshaft less than the outer wall portion of the first coolant feed passage.

10. A V-type engine having a crankshaft with an axis comprising a cylinder block having first and second cylinder banks, each cylinder bank having a side face and being provided with a row of cylinders extending between front and rear end faces of the cylinder block in the axial direction of the crankshaft, the row of the cylinders in the first cylinder bank starting from a location near the front end face of the cylinder block and the row of the cylinders in the second cylinder bank starting from a location spaced apart from the front end face of the cylinder block; first and second cylinder heads respectively mounted on the first and second cylinder banks; first and second camshafts respectively supported for rotation by the first and second cylinder heads, the camshafts operatively connected, at their one ends, with the crankshaft to be rotated in synchronization therewith; and an engine cooling system including a water pump for circulating coolant through water jackets formed in the first and second cylinder banks of the cylinder block around the cylinders, and a radiator; said water pump including a pump housing mounted on the front end face of the cylinder block to form, together with the front face of the cylinder block, a pump chamber, and an impeller supported by the pump housing for rotation in the pump chamber, said pump chamber being communicated with the radiator by way of a coolant inlet-passage formed in the cylinder block between the front end face thereof at the second cylinder bank and the cylinder nearest to the front end face in the second cylinder bank, and with said water jackets in the first and second cylinder banks, respectively, by way of first and second coolant feed passages formed in the cylinder block at the respective cylinder banks, said impeller being fixed to the rear end of a rotary shaft which is supported for rotation on the pump housing, said coolant inlet-passage opening, at one end, in the front end face of the cylinder block to communicate with the pump chamber from the side remote from the rotary shaft and being connected with a discharge conduit of the radiator at the other end.

11. A V-type engine as defined in claim 10 in which said coolant inlet-passage opens in the front end face of the cylinder block to be connected with the discharge conduit of the radiator.

12. A V-type engine as defined in claim 10 in which said coolant inlet-passage opens in the side face of the cylinder block to be connected with the discharge conduit of the radiator.

13. A V-type engine as defined in claim 10 in which said first and second camshafts are operatively connected with the crankshaft to be rotated in synchronization therewith, by way of cam pulleys fixedly mounted on one ends of the respective camshafts, a crank pulley fixedly mounted on the corresponding end of the crankshaft, and a transmission member entrained around the cam pulleys and the crank pulleys, said water pump being disposed inside the transmission member substantially at the center between the first and second cylinder banks.

14. A V-type engine as defined in claim 10 in which said first and second cylinder banks, and said first and second coolant feed passages extend toward said first and second cylinder banks, respectively, in directions opposite to each other relative to said water pump.

15. A V-type engine as defined in claim 14 in which said water pump is located approximately at the center between said first and second cylinder banks, and a part of each of said first and second feed passages is formed by the front end face of the cylinder block and the pump housing.

* * * * *